US009885509B2

(12) United States Patent
Madsen et al.

(10) Patent No.: US 9,885,509 B2
(45) Date of Patent: Feb. 6, 2018

(54) METHOD FOR CONTROLLING GAS PRESSURE IN COOLING PLANT

(71) Applicant: Danfoss A/S, Nordborg (DK)

(72) Inventors: Kenneth Bank Madsen, Ry (DK); Frede Schmidt, Sonderborg (DK)

(73) Assignee: Danfoss A/S, Nordborg (DK)

( * ) Notice: Subject to any disclaimer, the term of this patent is extended or adjusted under 35 U.S.C. 154(b) by 497 days.

(21) Appl. No.: 14/349,749

(22) PCT Filed: Oct. 5, 2012

(86) PCT No.: PCT/DK2012/000109

§ 371 (c)(1),
(2) Date: Apr. 4, 2014

(87) PCT Pub. No.: WO2013/050035

PCT Pub. Date: Apr. 11, 2013

(65) Prior Publication Data

US 2014/0331700 A1 Nov. 13, 2014

(30) Foreign Application Priority Data

| | | |
|---|---|---|
| Oct. 7, 2011 | (DK) | 2011 00779 |
| Nov. 18, 2011 | (DK) | 2011 00905 |
| Feb. 2, 2012 | (EP) | 12000707 |

(51) Int. Cl.
*F25B 1/00* (2006.01)
*F25B 49/00* (2006.01)
(Continued)

(52) U.S. Cl.
CPC ..... *F25B 49/027* (2013.01); *F25B 39/04* (2013.01); *F25B 49/005* (2013.01);
(Continued)

(58) Field of Classification Search
CPC F25B 49/027; F25B 49/005; F25B 2309/061; F25B 2600/17; F25B 2700/195; F25B 2700/2102; F25B 2400/0751
See application file for complete search history.

(56) References Cited

U.S. PATENT DOCUMENTS 7,600,390 B2 * 10/2009 Manole ..... F25B 1/10 62/228.1
2006/0236708 A1 10/2006 Mizuno et al.
(Continued)

FOREIGN PATENT DOCUMENTS

| | | |
|---|---|---|
| DE | 10 2006 019 082 A1 | 10/2006 |
| EP | 1 202 004 A1 | 5/2002 |
| WO | 2007/022778 A1 | 3/2007 |

OTHER PUBLICATIONS

Danish Search Report Serial No. PA201100905 dated Jun. 27, 2012.
International Search Report for PCT Serial No. PCT/DK2012/000109 dated Feb. 11, 2013.

*Primary Examiner* — Elizabeth Martin
(74) *Attorney, Agent, or Firm* — McCormick, Paulding & Huber LLP

(57) ABSTRACT

A method for monitoring gas pressure in a heat rejecting heat exchanger in a cooling circuit is disclosed. The present capacity of one or more compressors in the cooling circuit compared to a maximum capacity of the one or more compressors is established. If the present capacity of the one or more compressors is at least at a level corresponding to a pre-set percentage of the maximum capacity, a period of time elapsed from a point in time where the compressor capacity reached said level is established. If the established period of time has a duration which is longer than a pre-set period of time, then it is concluding that the cooling medium is in a gas loop operational mode, allowing an operator or a controller to adjust operation of the cooling plant such that
(Continued)

the cooling medium is brought out of the gas loop operational mode.

18 Claims, 2 Drawing Sheets

(51) Int. Cl.
*F25B 49/02* (2006.01)
*F25B 39/04* (2006.01)

(52) U.S. Cl.
CPC . *F25B 2309/061* (2013.01); *F25B 2313/0313* (2013.01); *F25B 2600/17* (2013.01); *F25B 2700/195* (2013.01); *F25B 2700/2102* (2013.01)

(56) References Cited

U.S. PATENT DOCUMENTS

| | | | | |
|---|---|---|---|---|
| 2007/0089439 | A1 | 4/2007 | Singh et al. | |
| 2007/0144193 | A1* | 6/2007 | Crane ..... | F25B 49/022 62/228.4 |
| 2009/0056348 | A1 | 3/2009 | Noll et al. | |

* cited by examiner

METHOD FOR CONTROLLING GAS PRESSURE IN COOLING PLANT

CROSS REFERENCE TO RELATED APPLICATIONS

This application is entitled to the benefit of and incorporates by reference subject matter disclosed in International Patent Application No. PCT/DK2012/000109 filed on Oct. 5, 2012; Danish Patent Application No. PA 2011 00779 filed Oct. 7, 2011; Danish Patent Application No. PA 2011 00905 filed Nov. 18, 2011; and European Patent Application EP 12 000707.5 filed Feb. 2, 2012.

FIELD OF THE INVENTION

The invention relates to a method for controlling of gas pressure in a heat rejecting heat exchanger of a cooling plant. The invention also relates to a control unit operating according to the method of the invention, and to a plant with such a control unit.

BACKGROUND

In cooling plants comprising heat rejecting heat exchangers, such as a gas cooler, gas cooler control may not succeed, when faults in the pressure being measured and/or faults in the temperature being measured at the outlet of the gas cooler exceeds normally expected values. FIG. 1 is a log P-h diagram showing how a read-out of a slightly too high pressure (upper limit of Δp) may result in the controller registering the pressure and/or the temperature at the outlet of the heat rejecting heat exchanger, for instance the gas cooler, to be at the optimal curve in point B in FIG. 1, while the physical situation, or the actual condition, is shown in point A in FIG. 1.

FIG. 1 illustrates how gas cooler control not succeeding, when faults in the pressure being measured and/or faults in the temperature being measured at the outlet of the gas cooler exceeds normally expected values affects the efficiency of the cooling plant. The continuous cycle marked by a continuous line represents the actual running cycle, while the cycle marked by the dashed line represents the cycle perceived by the controller. The two cycles require almost the same amount of energy per weight unit of refrigerant for compression, while the useful cooling capacity per weight unit of refrigerant is dramatically lower for the actual running cycle than for the cycle perceived by the controller.

Thus, while it is believed that the cooling plant is operated at near optimal conditions, it is in fact operated in a very energy inefficient manner. The problem is sometimes referred to as gas loop operation and may occur, where the isothermal lines are approximately horizontal in the log P-h diagram, as illustrated in FIG. 1.

WO2007022778 also describes the phenomena of 'gas loop operation', hereby incorporating entire WO2007022778 by reference. Reference is specifically, but not exclusively, made to page 5, lines 4-9, together with FIG. 4 of WO2007022778, said specific reference disclosing: In addition to the transcritical cooling cycle, FIG. 4 shows two isotherms 34, 36. It should be noted that a decrease of the gas cooler pressure at the point 3 moves the point 4 to the right by a large amount because of the low and almost horizontal slope of the isotherm 34 so that the available specific enthalpy for release in the evaporator decrease by a large amount. Since the specific enthalpy added by the compressor 14 decreases by a small amount, the resulting COP decreases by a large amount. Conversely, an increase of the gas cooler pressure at the point 3 moves the point 3 to the left by a small amount because of the steep slope of the isotherm 34 so that the available specific enthalpy for release in the evaporator increases by a small amount. Since the specific enthalpy added by the compressor 14 also increases by a small amount, the resulting COP hardly changes.

Gas loop operation reduces the cooling capacity to almost zero. It will result in the controller increasing the capacity of the compressor to 100%, and after a couple of minutes, the controller will increase the reference of the gas cooler.

DE 10 2006 019082 discloses a cooling apparatus for a vehicle. The apparatus includes a state detection unit (9, 9a, 13, 13a, 12, 14-16, 18, 19, 21, 22) for detecting a condition that an internal pressure of the refrigerant circuit exceeds a preset pressure. When it is detected that an internal pressure of the refrigerant exceeds the preset pressure, the apparatus controls a pressure reducing unit for reducing a pressure of the refrigerant on a low pressure side of a refrigeration cycle, when the condition is detected. When the state detecting unit detects the state, for example, starts the pressure reduction unit including a compressor of the cooling circuit so as to reduce the pressure on the low pressure side in the cooling circuit. DE 10 2006 019082 does not teach, and is not capable of, detecting a possible gas loop operational mode.

SUMMARY

It is an object of the present invention to provide a method for detecting and for recovering from gas loop operation. It is also an object to provide a control unit and a plant with such control unit having limited gas loop operation.

According to a first aspect the present invention provides a method for monitoring gas pressure in a heat rejecting heat exchanger in a cooling circuit, said method comprising the steps of:

- in the heat rejecting heat exchanger, controlling pressure by means of a control unit, said control unit controlling at least one valve,
- establishing the present capacity of one or more compressors in the cooling circuit compared to a maximum capacity of the one or more compressors,
- if the present capacity of the one or more compressors is at least at a level corresponding to a pre-set percentage of the maximum capacity, establishing a period of time elapsed from a point in time where the compressor capacity reached said level,
- if the established period of time has a duration which is longer than a pre-set period of time, then concluding that the cooling medium is in a gas loop operational mode.

In the present context the term 'cooling circuit' should be interpreted to mean a refrigerant path in which refrigerant is alternatingly compressed and expanded. To this end a compressor, a heat rejecting heat exchanger, an expansion device and a heat consuming heat exchanger are arranged in the refrigerant path. The compressor may be in the form of a single compressor or in the form of a rack of two or more compressors. The heat rejecting heat exchanger may be in the form of a condenser or a gas cooler, depending on whether the cooling circuit is operated subcritically or transcritically. The heat consuming heat exchanger may be an evaporator.

Refrigerant is compressed in the compressor before being supplied to the heat rejecting heat exchanger. In the heat rejecting heat exchanger, heat exchange takes place with a secondary fluid flow across the heat rejecting heat exchanger, in such a manner that the temperature of the refrigerant flowing through the heat rejecting heat exchanger, via the refrigerant path, is reduced. In the case that the heat rejecting heat exchanger is a condenser, gaseous refrigerant which enters the heat rejecting heat exchanger is at least partly condensed. In the case that the heat rejecting heat exchanger is a gas cooler, gaseous refrigerant which enters the heat rejecting heat exchanger remains gaseous, but the temperature of the refrigerant is reduced. In any event, the cooling circuit is capable of providing heating for a closed volume, via the heat rejecting heat exchanger.

The refrigerant is then supplied to the expansion device, where it is expanded before being supplied to the heat consuming heat exchanger. In the heat consuming heat exchanger, heat exchange takes place with a secondary fluid flow across the heat consuming heat exchanger, in such a manner that the temperature of the refrigerant flowing through the heat consuming heat exchanger, via the refrigerant path, is increased. In the case that the heat consuming heat exchanger is an evaporator, liquid refrigerant entering the heat consuming heat exchanger is at least partly evaporated in the heat consuming heat exchanger. Furthermore, the evaporated refrigerant may be heated further, in which case superheated refrigerant leaves the heat consuming heat exchanger. In any event, the cooling circuit is capable of providing cooling for a closed volume, via the heat consuming heat exchanger. The refrigerant is then returned to the compressor, and the cycle is repeated.

According to the method of the first aspect of the invention the present capacity of one or more compressors in the cooling circuit compared to a maximum capacity is established. In the present context the term 'capacity' should be interpreted to mean the work provided by the compressor(s). The capacity may be expressed in terms of the electrical energy or power consumed by the compressor(s), in terms of the amount of refrigerant being compressed and displaced by the compressor(s), in terms of the cooling load on the cooling plant, or in any other suitable manner.

The present compressor capacity may be measured. Alternatively, information regarding the present compressor capacity may be inherently present in the compressor controller, in which case the information is simply provided by the compressor controller.

The maximum capacity may be the rated capacity of the one or more compressors, the rated capacity being the maximum work which the compressor(s) is/are designed to deliver. As an alternative, the maximum capacity may be a capacity limit which is defined by various operating conditions of the cooling circuit, such as the outdoor temperature, the indoor temperature, the design of the cooling plant, the installation site, the desired temperature of the equipment and/or goods to be cooled, etc. For instance, the cooling plant may be over dimensioned in the sense that the compressor(s) is/are potentially capable of providing a significantly higher cooling capacity than will ever be necessary in order to meet the cooling load on the cooling plant. In this case the maximum capacity may be a specified percentage of the rated capacity, such as 75% of the rated capacity, 80% of the rated capacity, 90% of the rated capacity, or the like. The maximum capacity may advantageously be a compressor capacity which is required when the cooling load on the cooling plant is at a maximum level.

If it is established that the present capacity of the one or more compressors is at least at a level corresponding to a pre-set percentage of the maximum capacity, it is investigated when this level was reached, and for how long the compressor capacity has been at or above this level. In other words, it is investigated whether the one or more compressors is/are operating at a relatively high capacity, at or close to the maximum capacity as defined above, and has/have been doing so for a while. If the compressor(s) is/are operating at a high capacity level during a continuous time period, it is an indication that the cooling plant is operating inefficiently, and that the cooling medium may be in a gas loop operational mode.

Accordingly, if the established period of time has a duration which is longer than a pre-set period of time, it is concluded that the cooling medium is in a gas loop operational mode.

Thus, the method according to the first aspect of the invention allows a gas loop condition to be identified in an easy manner. This, in turn, allows the operation of the cooling plant to be adjusted in such a manner that the cooling medium is brought out of the gas loop operational mode. Furthermore, since the compressor capacity has to be at a high level for at least a pre-set period of time, it is ensured that short spikes of high capacity are not reacted upon. This is an advantage, because such short spikes may be the result of fluctuations, rather than indicating a gas loop operational mode.

The method may comprise the further step of increasing the pressure of the cooling medium inside the heat rejecting heat exchanger, if it is concluded that the cooling medium is in a gas loop operational mode.

As shown in FIG. 1, when the pressure in the heat rejecting heat exchanger (gas cooler) increases, the pressure and the enthalpy of the cooling medium are displaced into a region, where the isothermal curves have a more pronounced slope. Thereby the operation of the cooling plant is pulled away from gas loop operational mode.

The pressure of the cooling medium may be increased by 5-20 bars, such as by 7-15 bars, such as by 8-10 bars, such as approximately 10 bars, or approximately 5 bars, or approximately 20 bars.

Alternatively, the pressure of the cooling medium may be increased by 1%-15%, such as by 2%-12%, such as by 5%-10%, such as by approximately 7%, or approximately 5%, or approximately 10%.

The step of increasing the pressure may result in a pressure increase which causes the present capacity of the one or more compressors to decrease to below 95% of the maximum capacity, possibly to below 90% of the maximum capacity, even possibly to below 80% of the maximum capacity. According to this embodiment, the pressure increase moves the cooling medium out of the gas loop operation mode, and thereby operation of the compressor(s) is moved away from the very high capacity level.

The method may further comprise the step of decreasing the pressure of the cooling medium inside the heat rejecting heat exchanger, if it can be concluded that the cooling medium is no longer in a gas loop operational mode. According to this embodiment, the increased pressure of the cooling medium inside the heat rejecting heat exchanger is only maintained as long as required in order to move the cooling medium out of the gas loop operational mode. Once this has been obtained, the pressure is once again reduced, and the cooling plant is returned to normal operation.

The duration within which the pressure of the cooling medium is increased may differ depending on which percentage of the maximum capacity is decided as being relatively high or full capacity of the one or more compressors. For instance, if the percentage of the maximum capacity is decided as being 90%, the increase in pressure will be terminated, when the present capacity decreases to below 90% of the maximum capacity.

The pre-set percentage of the maximum capacity of the one or more compressors may be at least 80% of the maximum capacity, possibly at least 90% of the maximum capacity, even possibly between 95% and 100% of the maximum capacity of the one or more compressors, even more possible 100% of the maximum capacity. In any event, the present capacity of the one or more compressors should be very close to the maximum capacity for a significant period of time before it can be concluded that the cooling medium is in a gas loop operational mode.

The pre-set period of time of a certain duration may be at least one minute, preferably at least two minutes, possibly at least three minutes, even possible at least four minutes, and even more possible at least five minutes, possibly at the most 15 minutes.

The duration within which the one or more compressors of the cooling plant operate at a capacity decided as being maximum capacity, or close to maximum capacity, may differ depending on the installation site, the outdoor and indoor temperature, the desired temperature of the equipment and/or goods to be cooled, etc. Therefore, under some conditions, a shorter period of time is enough for concluding that the cooling medium is in a gas loop operational mode, and under other conditions a longer period of time is needed for concluding that the cooling medium is in a gas loop operational mode.

The present capacity of the one or more compressors may be established commonly for all the compressors of the cooling circuit. According to this embodiment, the combined capacity of all of the compressors is established in one go, and compared to the maximum combined capacity. Thus, the sum of capacity of the entire cooling plant is established for obtaining the capacity of all compressors, if the cooling plant comprises more than one compressor.

As an alternative, the present capacity of the one or more compressors may be established individually for each compressor of the cooling circuit. According to this embodiment, the capacity of each of the compressors is established and compared to the maximum capacity for that compressor.

According to a second aspect the present invention provides a control unit for monitoring pressure in a heat rejecting heat exchanger of a cooling circuit comprising one or more compressors, said control unit comprising a pressure measuring unit and a capacity establishing unit for measuring the pressure of the cooling medium inside the heat rejecting heat exchanger and for establishing the capacity of the one or more compressors, respectively, and said control unit also comprising a timer for measuring a period of time having elapsed from a point of time, said point of time being when the present capacity of the compressors reaches a pre-set percentage of a maximum capacity, said timer communicating with said capacity establishing unit for establishing, by means of the method according to the first aspect of the invention, whether the cooling medium is in a gas loop operational mode.

The control unit according to the second aspect of the invention is adapted to establish whether or not a cooling medium of a cooling circuit is in a gas loop operational mode, by means of the method according to the first aspect of the invention. Therefore the remarks set forth above are equally applicable here.

According to a third aspect the present invention provides a plant with a cooling circuit comprising one or more compressors, said plant also comprising at least one heat rejecting heat exchanger and a controller for controlling pressure in the heat rejecting heat exchanger, and said plant also comprising at least one valve for adjusting the pressure in the heat rejecting heat exchanger, and the plant also comprising a pressure measuring unit and a capacity establishing unit for measuring the pressure of the cooling medium inside the heat rejecting heat exchanger and establishing the capacity of one or more compressors, respectively, and said plant also comprising a timer for measuring a period of time having elapsed from a point of time, said point of time being when the present capacity of the compressors reaches a pre-set percentage of a maximum capacity, said timer communicating with said capacity establishing unit for establishing, by means of the method according to the first aspect of the invention, whether the cooling medium is in a gas loop operational mode, said gas loop operational mode being an operational mode, where faults in the pressure being measured and/or faults in the temperature being measured at the outlet of a gas cooler exceeds normally expected values.

BRIEF DESCRIPTION OF THE DRAWINGS

The invention will now be described in further detail with reference to the accompanying drawings in which.

DETAILED DESCRIPTION

Figure 1:
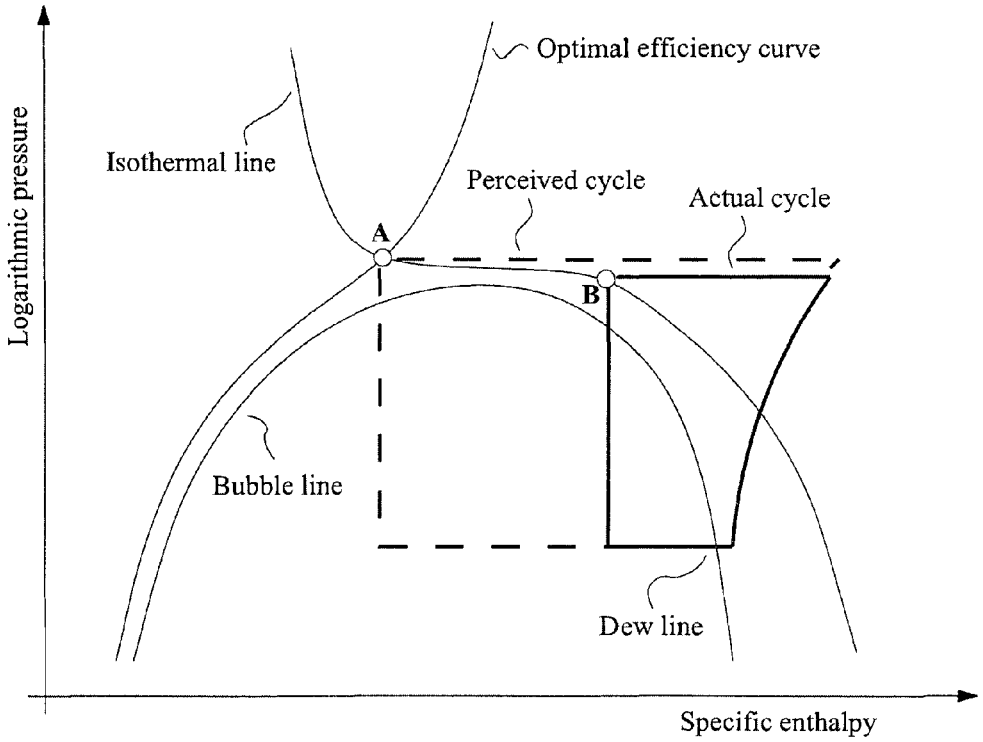
FIG. 1 is a log P-h diagram illustrating a gas loop operational mode of a cooling medium.

FIG. 1 is a log P-h diagram illustrating a gas loop operational mode of a cooling medium in a cooling plant. The cooling plant is operated transcritically, i.e. no phase transition takes place during heat exchange in the heat rejecting heat exchanger. FIG. 1 illustrates that when the cooling medium is operated in a region where the isothermal curve is relatively flat, small variations in pressure results in large variations in enthalpy. Therefore a measurement of the pressure of the cooling medium leaving the gas cooler may lead the controller to believe that the cooling medium is at the optimal operating point B. However, due to a small error in the measurement ($\Delta p$), the cooling medium may in fact be at the very inefficient operating point A. As a consequence, the cooling plant is not operated in an optimal manner. Since this is not registered by the controller, the operation of the cooling plant continues to be inefficient. This situation is sometimes referred to as gas loop operation.

Figure 2:
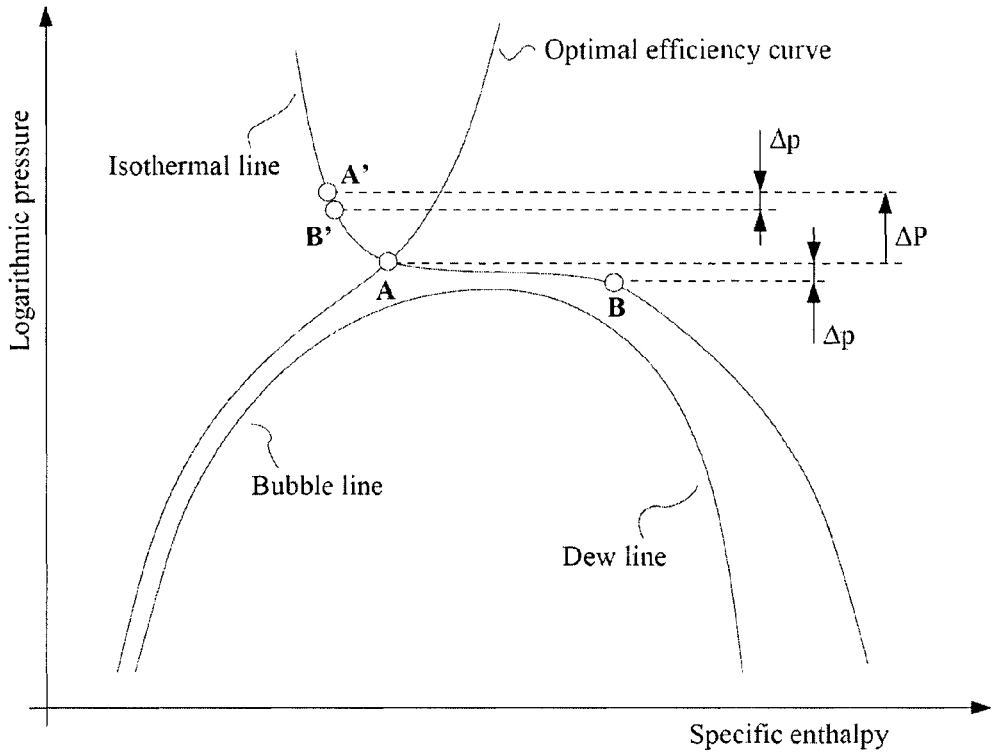
FIG. 2 is a log P-h diagram illustrating the effect of increasing the pressure of the cooling medium in a gas cooler.

FIG. 2 is a log P-h diagram, similar to the diagram of FIG. 1. FIG. 2 also illustrates the gas loop operational mode described above with reference to FIG. 1. In FIG. 2 a small error ($\Delta p$) in the measurement of the pressure of the cooling medium leaving the gas cooler may lead the controller to believe that the cooling medium is at the optimal operating point A, while it is in fact at the very inefficient operating point B.

However, increasing the pressure level in the gas cooler by AP changes the situation dramatically, because the operating points are thereby moved to a region of the isothermal curve which is much steeper. Thus, it is clear from FIG. 2 that a small error ($\Delta p$) in the measurement of the pressure of the cooling medium leaving the gas cooler leads to only a small difference in enthalpy. In other words, operating the cooling plant at operating point A' or at operating point B' has no significant impact on the efficiency of the cooling plant. Thus, it can be seen that increasing the pressure of the cooling medium in the gas cooler brings the cooling medium out of the gas loop operational mode.

Although various embodiments of the present invention have been described and shown, the invention is not restricted thereto, but may also be embodied in other ways within the scope of the subject-matter defined in the following claims.

What is claimed is:

1. A method for monitoring gas pressure in a heat rejecting heat exchanger in a cooling circuit, said method comprising the steps of:

a control unit controlling pressure in the heat rejecting heat exchanger by controlling at least one valve;

the control unit establishing a present capacity of one or more compressors in the cooling circuit compared to a maximum capacity of the one or more compressors;

in response to the control unit establishing that the present capacity of the one or more compressors is at least at a level corresponding to a pre-set percentage of the maximum capacity, the control unit establishing a period of time elapsed from a point in time where the compressor capacity reached said level;

in response to the control unit determining that the established period of time has a duration which is longer than a pre-set period of time, the control unit concluding that the cooling circuit is in a gas loop operational mode; and in response to the control unit concluding that the cooling circuit is in the gas loop operational mode, increasing the pressure of the cooling medium inside the heat rejecting heat exchanger.

2. The method according to claim 1, wherein the pressure of the cooling medium is increased by 5-20 bars.

3. The method according to claim 1, wherein the pressure of the cooling medium is increased by 1%-15%.

4. The method according to claim 1, wherein the step of increasing the pressure results in a pressure increase which causes the present capacity of the one or more compressors to decrease to below 95% of the maximum capacity.

5. The method according to claim 1, further comprising the step of decreasing the pressure of the cooling medium inside the heat rejecting heat exchanger, in response to the control unit concluding that the cooling circuit is no longer in the gas loop operational mode.

6. The method according to claim 1, wherein the pre-set percentage of the maximum capacity of the one or more compressors is at least 80% of the maximum capacity.

7. The method according to claim 1, wherein the pre-set period of time of a certain duration is at least one minute.

8. The method according to claim 1, wherein the present capacity of the one or more compressors is established by the control unit commonly for all the compressors of the cooling circuit.

9. The method according to claim 1, wherein the present capacity of the one or more compressors is established by the control unit individually for each compressor of the cooling circuit.

10. A control unit for monitoring pressure in a heat rejecting heat exchanger of a cooling circuit comprising one or more compressors, said control unit comprising a pressure measuring unit and a capacity establishing unit for measuring the pressure of the cooling medium inside the heat rejecting heat exchanger and for establishing the capacity of the one or more compressors, respectively, and said control unit also comprising a timer for measuring a period of time having elapsed from a point of time, said point of time being when the present capacity of the compressors reaches a pre-set percentage of a maximum capacity, said timer communicating with said capacity establishing unit for establishing, by means of the method according to claim 1, whether the cooling medium is in a gas loop operational mode.

11. A plant with a cooling circuit comprising one or more compressors, said plant also comprising at least one heat rejecting heat exchanger and a controller for controlling pressure in the heat rejecting heat exchanger, and said plant also comprising at least one valve for adjusting the pressure in the heat rejecting heat exchanger, and the plant also comprising a pressure measuring unit and a capacity establishing unit for measuring the pressure of the cooling medium inside the heat rejecting heat exchanger and establishing the capacity of one or more compressors, respectively, and said plant also comprising a timer for measuring a period of time having elapsed from a point of time, said point of time being when the present capacity of the compressors reaches a pre-set percentage of a maximum capacity, said timer communicating with said capacity establishing unit for establishing, by means of the method according to claim 1, whether the cooling medium is in a gas loop operational mode.

12. The method according to claim 2, wherein the pressure of the cooling medium is increased by 1%-15%.

13. The method according to claim 2, wherein the step of increasing the pressure results in a pressure increase which causes the present capacity of the one or more compressors to decrease to below 95% of the maximum capacity.

14. The method according to claim 3, wherein the step of increasing the pressure results in a pressure increase which causes the present capacity of the one or more compressors to decrease to below 95% of the maximum capacity.

15. The method according to claim 2, further comprising the step of decreasing the pressure of the cooling medium inside the heat rejecting heat exchanger, in response to the control unit concluding that the cooling circuit is no longer in the gas loop operational mode.

16. The method according claim 3, further comprising the step of decreasing the pressure of the cooling medium inside the heat rejecting heat exchanger, in response to the control unit concluding that the cooling circuit is no longer in the gas loop operational mode.

17. The method according to claim 4, further comprising the step of decreasing the pressure of the cooling medium inside the heat rejecting heat exchanger, in response to the control unit concluding that the cooling circuit is no longer in the gas loop operational mode.

18. The method according to claim 2, wherein the pre-set percentage of the maximum capacity of the one or more compressors is at least 80% of the maximum capacity.

* * * * *